US007487981B2

(12) United States Patent
Cromie

(10) Patent No.: US 7,487,981 B2
(45) Date of Patent: Feb. 10, 2009

(54) SEAT DELIVERY PALLET

(75) Inventor: Victor Cromie, Newcastle (IE)

(73) Assignee: BE Aerospace, Inc., Wellington, FL (US)

( * ) Notice: Subject to any disclaimer, the term of this patent is extended or adjusted under 35 U.S.C. 154(b) by 107 days.

(21) Appl. No.: 11/561,994

(22) Filed: Nov. 21, 2006

(65) Prior Publication Data

US 2007/0137532 A1 Jun. 21, 2007

Related U.S. Application Data

(60) Provisional application No. 60/597,304, filed on Nov. 22, 2005.

(51) Int. Cl.
*B62B 1/00* (2006.01)

(52) U.S. Cl. ..... 280/79.11; 280/79.2; 280/35; 414/346

(58) Field of Classification Search ..... 280/79.11, 280/79.2, 47.33, 408, 651, 33.998, 35, 641; 297/DIG. 4, 130, 335, 331, 336, 231; 414/346, 414/347, 471; 410/51, 104
See application file for complete search history.

(56) References Cited

U.S. PATENT DOCUMENTS 1,723,085 A * 8/1929 Sippel ..... 280/79.11
2,537,909 A * 1/1951 Puddester ..... 280/79.11
2,558,144 A * 6/1951 McComie ..... 280/35
2,961,250 A * 11/1960 Beach ..... 280/35
3,582,102 A * 6/1971 Bewick ..... 280/33.998
3,945,449 A * 3/1976 Ostrow ..... 280/35
5,120,017 A * 6/1992 Feener, III ..... 297/130
5,135,350 A * 8/1992 Eelman et al. ..... 414/347
5,137,403 A * 8/1992 McCaffrey ..... 410/51
5,158,338 A * 10/1992 Hayakawa et al. ..... 297/335
5,529,378 A * 6/1996 Chaban et al. ..... 297/331
5,687,984 A * 11/1997 Samuel ..... 280/641
6,010,296 A * 1/2000 Enders ..... 414/346
6,042,127 A * 3/2000 Rupolo ..... 280/33.998
6,059,345 A * 5/2000 Yokota ..... 297/331
6,773,050 B1 * 8/2004 Hotary et al. ..... 297/236

* cited by examiner

*Primary Examiner*—Hau V Phan
(74) *Attorney, Agent, or Firm*—Adams Intellectual Property Law, P.A.

(57) ABSTRACT

The invention relates to a reuseable seat delivery pallet for transporting seats. The seat delivery pallet includes a platform, and spaced-apart first and second locking tracks positioned on the platform for securing a seat thereto. The first and second locking tracks are adapted to receive feet of the seat therein and to permit the seat slide between a locking position and a release position. The seat delivery pallet also including a lock positioned on the platform for cooperating with the seat to maintain the seat in the locking position.

13 Claims, 7 Drawing Sheets

SEAT DELIVERY PALLET

CROSS-REFERENCE TO RELATED APPLICATIONS

This application claims the benefit of Provisional Application No. 60/597,304, filed on Nov. 22, 2005.

TECHNICAL FIELD AND BACKGROUND OF THE INVENTION

The present invention relates to the field of delivery pallets for the delivery of parts, assemblies, or products. In particular, the invention relates to a reuseable seat delivery pallet for solely transporting seats, such as an aircraft seat, to a site with minimal packaging.

Pallets are flat structures used to transport parts, assemblies, or products that are heavy, or require a substantially stiff structure to prevent twisting. One particular use has been to use pallets for the transportation of aircraft seats. The pallets allow the seats to be fastened to the pallet and delivered to a site without damage. However, the seats are typically fastened to the pallets using screws or bolts, requiring removal of the screws or bolts before removing the seats from the pallet. Additionally, due to the weight of the seats and pallet, a forklift or other type of machinery is needed to move the seats to the desired location.

Accordingly, there is a need for a seat delivery pallet that allows a seat to be secured to the pallet, that does not require the use of separate fasteners, that is easily moved without the use of a forklift or other machinery, and that is reuseable.

SUMMARY OF THE INVENTION

Therefore it is an object of the invention to provide a seat delivery pallet that minimizes packaging.

It is another object of the invention to provide a seat delivery pallet that is reuseable.

It is another object of the invention to provide a seat delivery pallet that allows a seat to be easily secured to or removed from the seat delivery pallet without the use of removable bolts or other fasteners.

It is another object of the invention to provide a seat delivery pallet that locks a seat in position on the seat delivery pallet.

These and other objects of the present invention are achieved in the preferred embodiments disclosed below by providing a seat delivery pallet including a platform, and spaced-apart first and second locking tracks positioned on the platform for securing a seat thereto. The first and second locking tracks are adapted to receive feet of the seat therein and to permit the seat to slide between a locking position and a release position. The seat delivery pallet also including a lock positioned on the platform for cooperating with the seat to maintain the seat in the locking position.

According to another preferred embodiment of the invention, each of the first and second locking tracks includes spaced-apart sidewalls extending the length of the track, and a slot positioned between the spaced-apart sidewalls for receiving the feet therein.

According to another preferred embodiment of the invention, each of the spaced-apart sidewalls includes a horizontally oriented shoulder that extends inwardly from the respective sidewall to provide an undercut area beneath the shoulder so as to prevent feet positioned in the slot from moving vertically.

According to another preferred embodiment of the invention, the first and second locking tracks are positioned on the platform substantially parallel to each other.

According to another preferred embodiment of the invention, the seat delivery pallet further includes insertion recesses for receiving feet of the seat therein and to allow the seat to be translated such that the feet are positioned in the first and second locking tracks for movement into the locking position.

According to another preferred embodiment of the invention, the insertion recesses are integral with the first and second locking tracks.

According to another preferred embodiment of the invention, each of the first and second locking tracks includes a recess formed adjacent to and cooperating with a gap in the locking track to allow the feet to be installed or removed from the first and second tracks when the feet are in the released position.

According to another preferred embodiment of the invention, the lock is positioned adjacent to the first locking track to selectively block movement of the seat when the seat is in the locking position.

According to another preferred embodiment of the invention, the lock is positioned in a recess of the platform adjacent to the first locking track to allow the lock to extend through a sidewall of the first locking track and block movement of the seat when the seat is in the locking position.

According to another preferred embodiment of the invention, the lock includes a pin and an actuating device operable to force the pin through the sidewall of the first locking track to a position where the pin interferes with a foot of the seat to prevent movement of the seat when the seat is in the locking position.

According to another preferred embodiment of the invention, a sleeve is positioned in the sidewall of the first locking track to allow the pin to slide therethrough.

According to another preferred embodiment of the invention, the seat delivery pallet further includes a plurality of castors attached to a bottom of the platform.

According to another preferred embodiment of the invention, a seat delivery pallet adapted to secure a seat having feet with enlarged locking studs including a platform, and spaced-apart, generally parallel first and second locking tracks positioned on the platform. The first and second locking tracks are adapted to receive the feet therein such that the feet can slide between a locking position and a release position while preventing the feet from moving vertically out of the locking tracks. Each of the first and second locking tracks includes spaced-apart horizontally disposed shoulders adapted to provide an interference and prevent the feet from moving vertically out of the track, a recess formed adjacent to and cooperating with a gap in each of the locking tracks to allow the feet to be inserted within the first and second tracks, and a lock moveable between a lock position and a release position. The lock is positioned adjacent to the first locking track to selectively prevent a seat from sliding within the first and second locking tracks when in the lock position.

According to another preferred embodiment of the invention, a method of delivering a seat having feet with enlarged locking studs includes the steps of providing a seat delivery pallet, positioning the seat in the first and second locking tracks, and locking the seat in the locking tracks to prevent removal of the seat from the platform. The delivery pallet includes a platform, spaced-apart first and second locking tracks positioned on the platform, and a lock positioned on the platform.

According to another preferred embodiment of the invention, the method further includes the step of positioning feet of the seat into respective insertion recesses adjacent the first and second locking tracks to permit the feet to be slid into the first and second locking tracks.

According to another preferred embodiment of the invention, the lock is positioned adjacent to the first locking track and is moveable between a release position and a lock position.

According to another preferred embodiment of the invention, the step of locking the seat in the locking position includes the step of sliding the seat from a release position where the seat can be removed from the platform to the locking position where the seat is secured to the platform.

According to another preferred embodiment of the invention, the method further includes the step of moving the lock from the release position to the lock position such that the lock prevents the seat from sliding in the first and second locking tracks toward the release position.

According to another preferred embodiment of the invention, the method further includes the step of removing the seat from the seat delivery pallet.

According to another preferred embodiment of the invention, the step of removing the seat from the seat delivery pallet includes the steps of sliding the feet in the first and second locking tracks from the locked position to the release position, and removing the feet of the seat out of engagement with the first and second locking tracks.

BRIEF DESCRIPTION OF THE DRAWINGS

The invention may be best understood by reference to the following description in conjunction with the accompanying drawing figures in which.

DESCRIPTION OF THE PREFERRED EMBODIMENT AND BEST MODE

Figure 1:
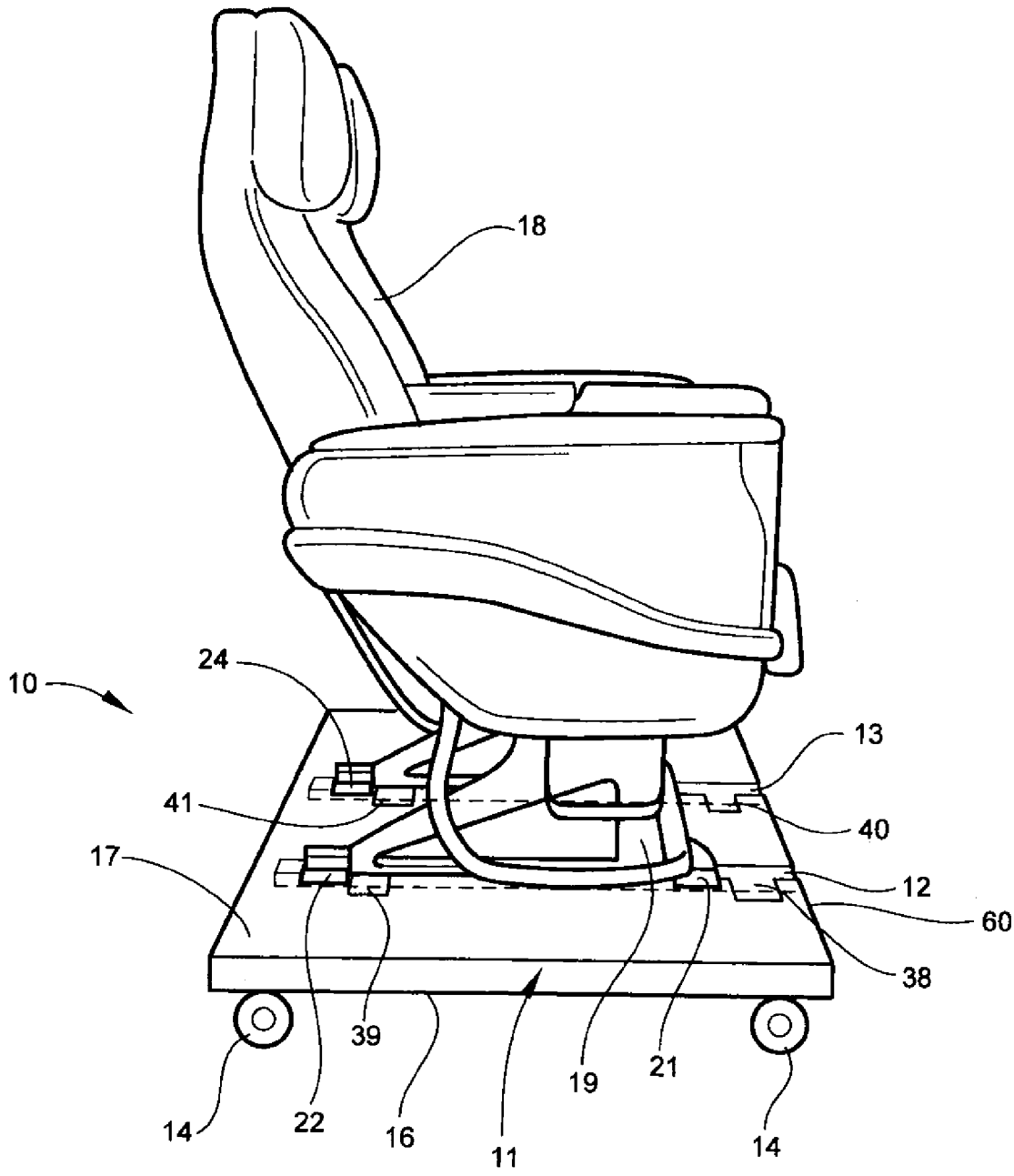
FIG. 1 is a fragmentary perspective view of a seat delivery pallet with a seat mounted thereon.
Figure 2:
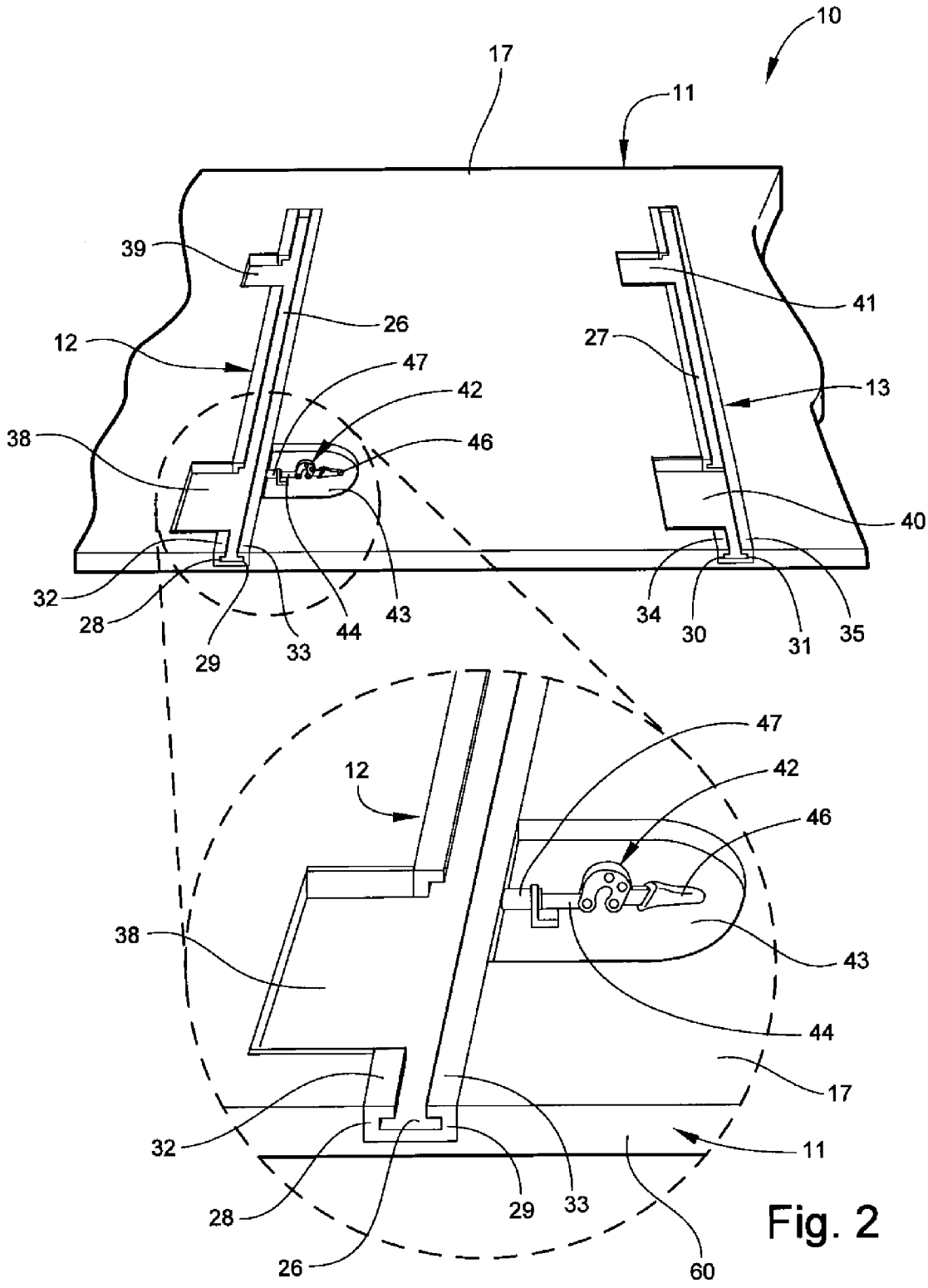
FIG. 2 shows the top surface of the seat delivery pallet of FIG. 1.
Figure 3:
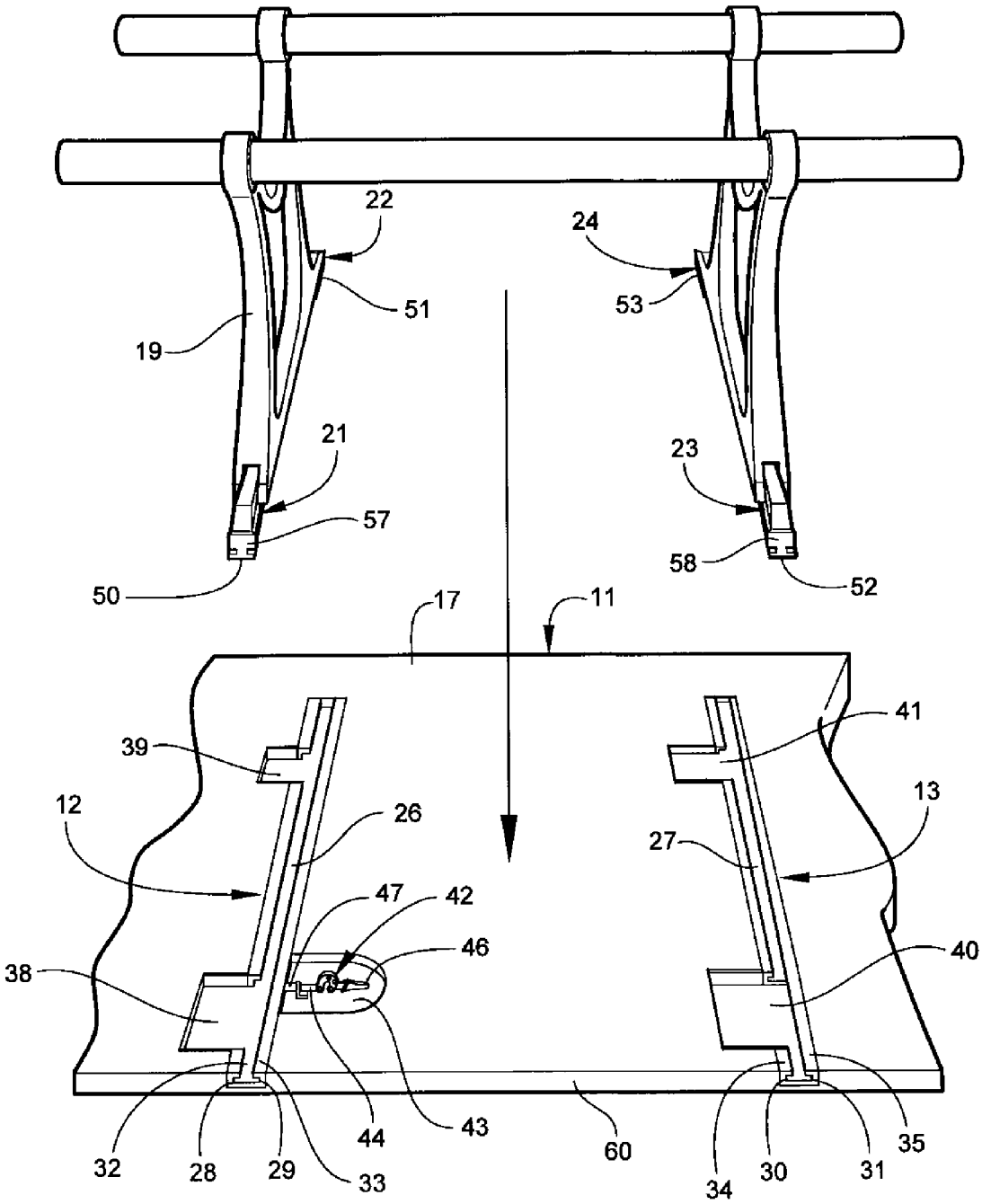
FIG. 3 shows a frame of the seat of FIG. 1 being positioned on the seat delivery pallet.
Figure 4:
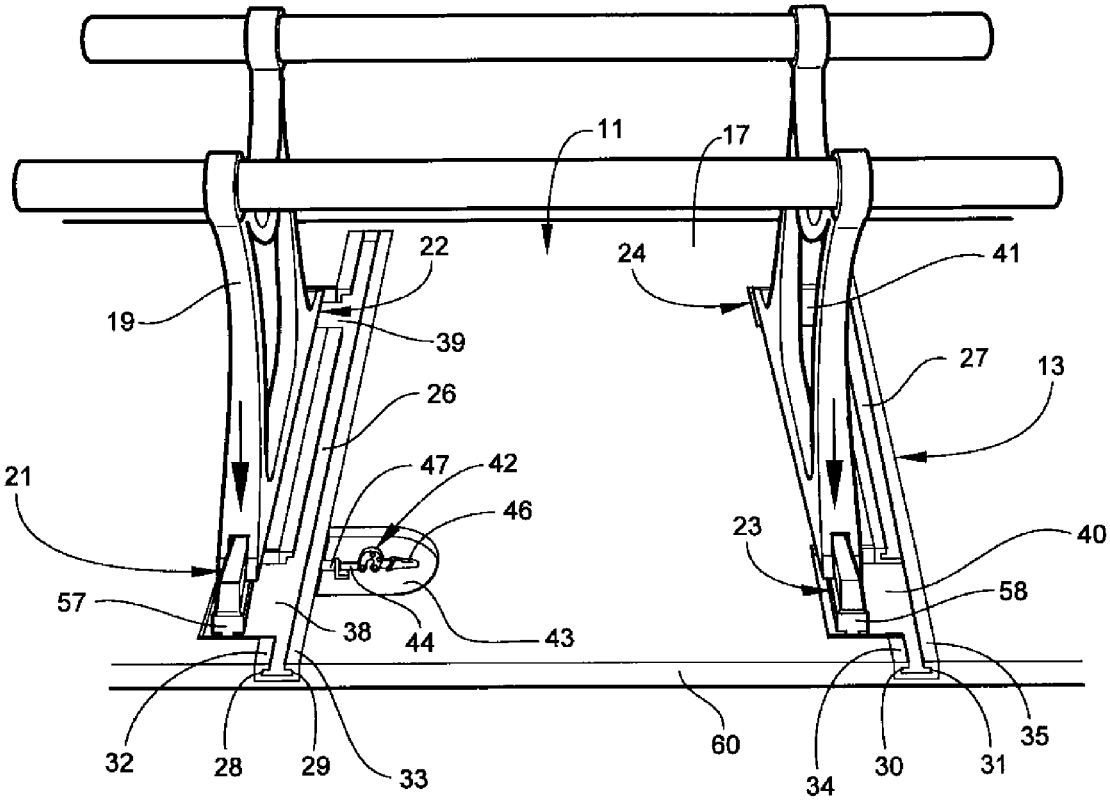
FIG. 4 shows the seat frame of FIG. 3 positioned in recesses on the seat delivery pallet of FIG. 2.

Referring now specifically to the drawings, a seat delivery pallet according to an embodiment of the invention is illustrated in FIGS. 1 and 2 and shown generally at reference numeral 10. The seat delivery pallet 10 includes a platform 11 and a pair of spaced-apart, generally parallel, locking tracks 12 and 13. Wheels or rollers, such as castors 14, are secured to a bottom surface 16 of the platform 11 to allow the pallet 10 to be rolled as needed. However, a forklift may be used, if desired. The platform 11 may be manufactured out of wood, metal, plastic, or any other suitable material.

The locking tracks 12 and 13 are mounted in a top surface 17 of the platform 11 to allow sliding movement and to lock against vertical movement of a seat 18. As illustrated, the seat 18 includes a frame 19 and feet 21-24. Tracks 12 and 13 include respective slots 26 and 27 positioned between respective spaced-apart sidewalls 28, 29 and 30, 31 that extend the entire length of the tracks 12 and 13. A pair of opposing, horizontally disposed, shoulders 32, 33 and 34, 35 extend inwardly from the sidewalls 28, 29 and 30, 31 into the slots 26 and 27 to provide undercut areas beneath the shoulders 32, 33 and 34, 35. Recesses 38, 39 are formed adjacent to and cooperate with gaps in the track 12 to allow the seat 18 to be positioned on the platform 11 and secured within the track 12. Recesses 40, 41 are formed adjacent to and cooperate with gaps in the track 13 to allow the seat 18 to positioned on the platform 11 and secured within the track 13.

As illustrated, a lock 42 is positioned adjacent to the track 12 opposite recess 38 in a recess 43. The lock 42 is moveable between a lock position, FIG. 7, and a release position, FIG. 6, and includes a pin 44 and an actuating device, such as a lever 46. The lever 46 forces the pin 44 through a sleeve 47 extending through sidewall 29 of the track 12 to a position where the pin 44 blocks forward movement from the lock position of the feet 21-24 positioned within the tracks 12 and 13.

In FIGS. 3-7, in which only the frame 19 and feet 21-24 of the seat 18 are shown for clarity, the frame 19 is positioned over the platform 11 with the feet 21-24 positioned over respective recesses 38-41. Feet 21-24 include enlarged locking studs 50-53, respectively, for being received within the slots 26 and 27.

Figure 5:
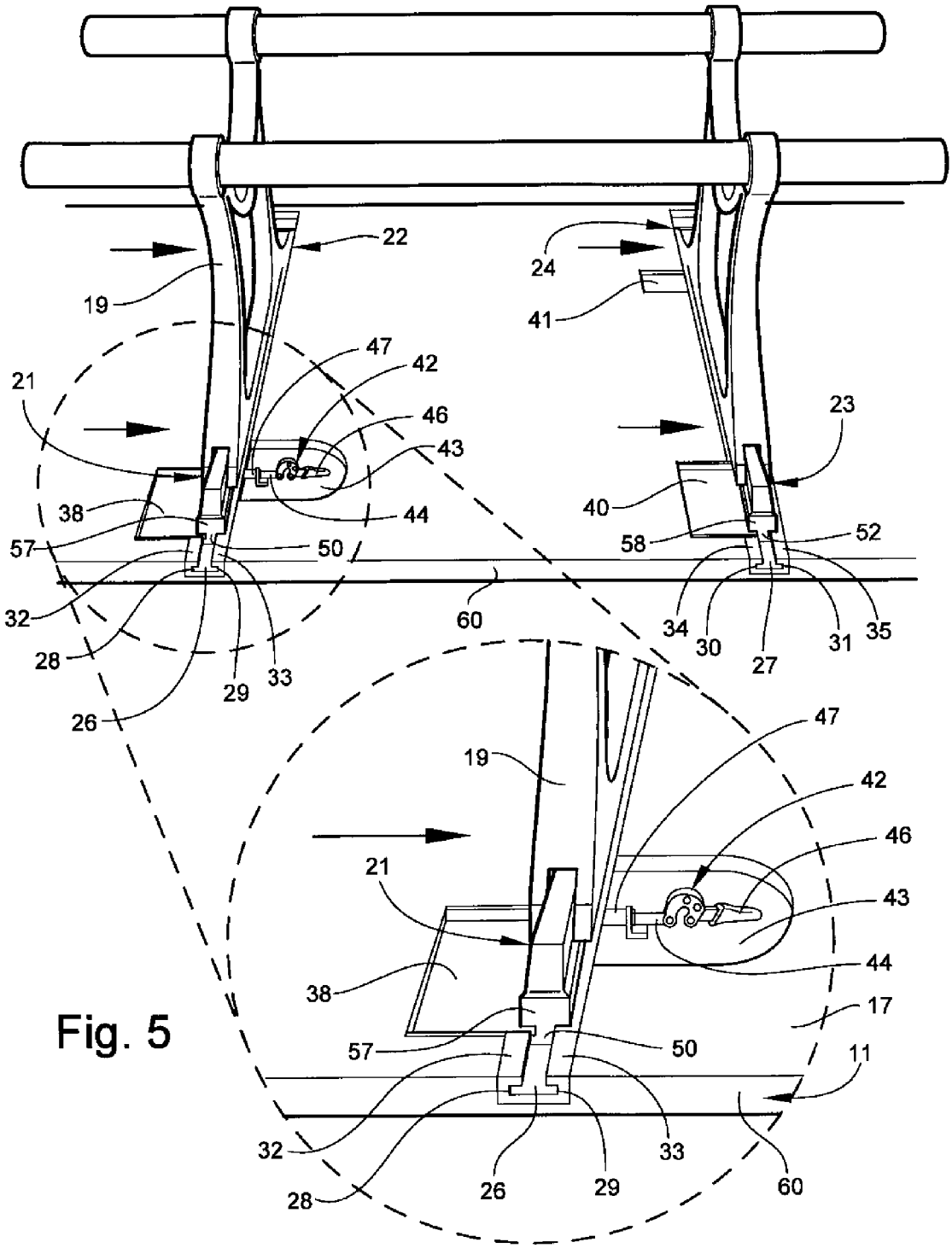
FIG. 5 shows the seat frame being moved into tracks on the seat delivery pallet of FIG. 2.
Figure 6:
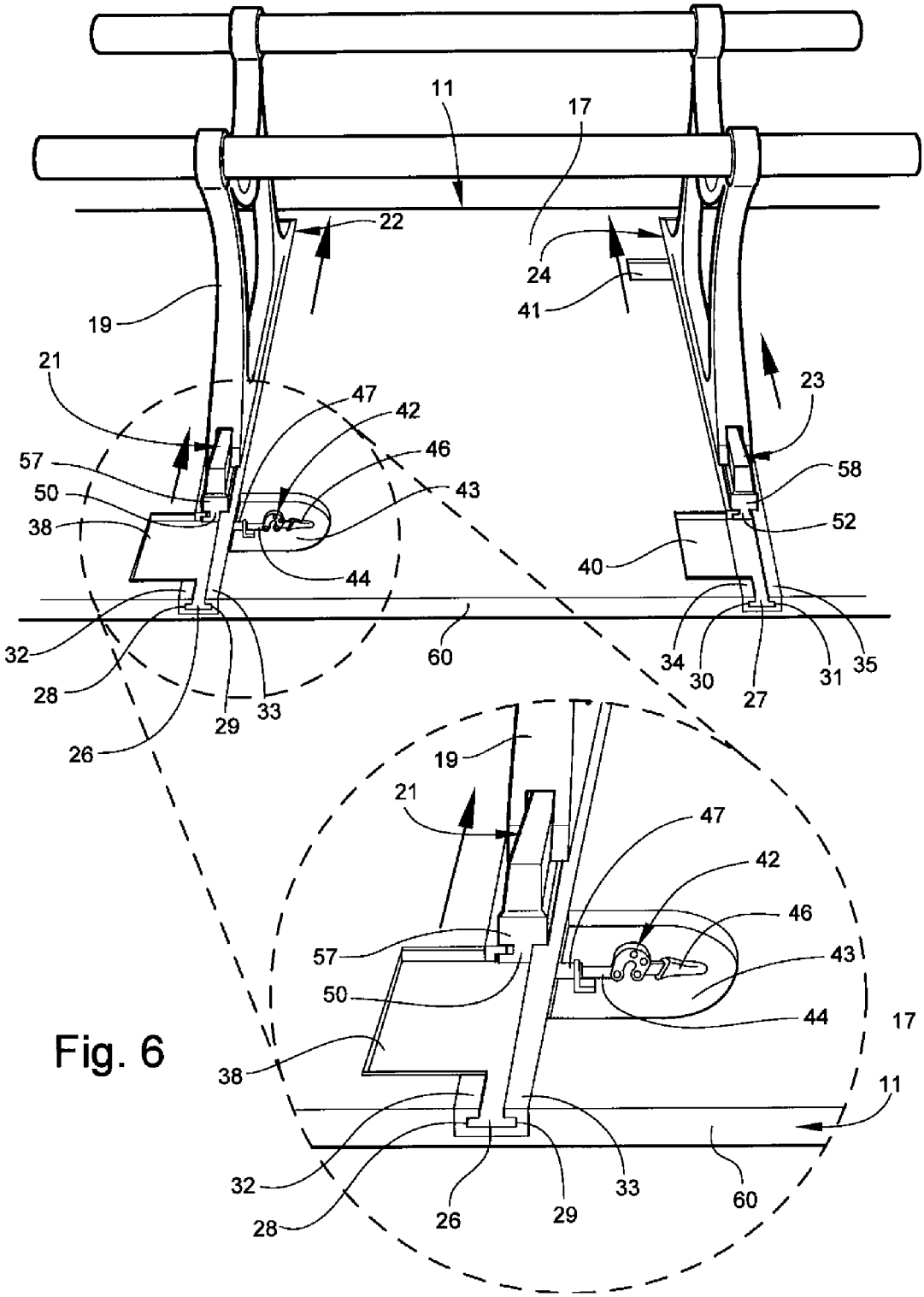
FIG. 6 shows the seat frame being moved within the tracks of FIG. 5.

Referring to FIGS. 5 and 6, the frame 19 is moved laterally in the recesses 38-41 to position the feet 21-24 into the tracks 12 and 13, thereby positioning the studs 50-53 in the slots 26 and 27. With the studs 50-53 positioned in the slots 26 and 27, the seat 18 is slid to the ends of the tracks 12 and 13, with front ends 57 and 58 of the feet 21 and 23 positioned behind the lock 42. When sliding the feet 21-24, the studs 50-53 slide within the slots 26 and 27 in the undercut areas beneath the shoulders 32, 33 and 34, 35 to lock the seat 18 against vertical movement while still allowing sliding movement of the seat 18 along the slots 26 and 27.

Figure 7:
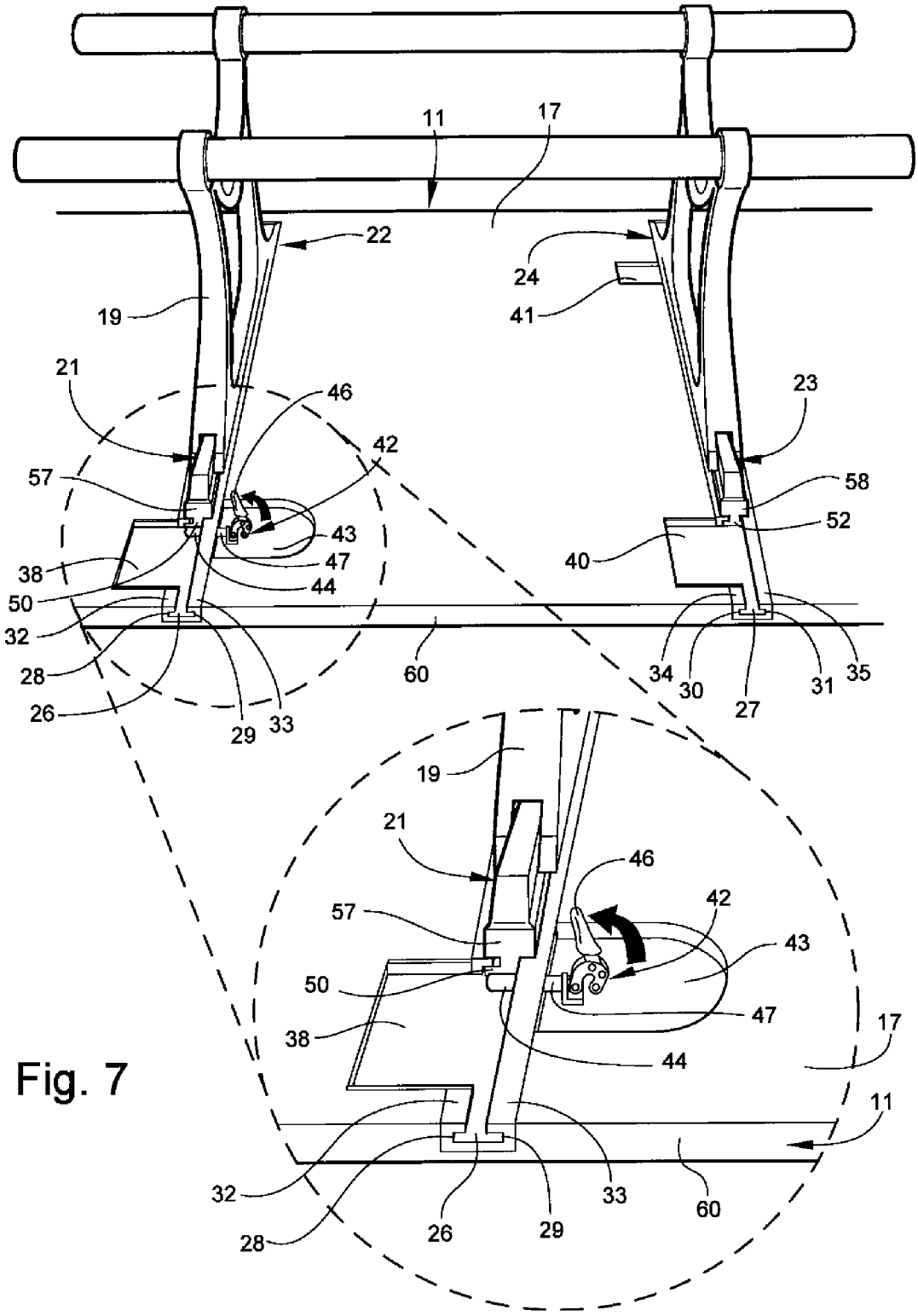
FIG. 7 shows the seat frame being locked in position within the tracks of FIG. 5.

As shown in FIG. 7, the lock 42 is then engaged to lock the feet 21-24 in their fixed position in the tracks 12 and 13. When the lever 46 is moved to an upright locked position, the pin 44 is forced through the sleeve 47 and across the track 12 to block foot 21. The lever 46 remains in the locked position to prevent the pin 44 from withdrawing from the track 12. As shown, a single lock 42 is used; however, additional locks 42 may be used if desired.

To remove the seat 18 from the tracks 12 and 13, the lever 46 is moved to the release position, shown in FIGS. 2-6, allowing the feet 21-24 to slide towards a front edge 60 of the platform 11. The feet 21-24 are then slid laterally into the recesses 38-41, allowing the seat 18 to be lifted upwardly and removed from the platform 11. The pallet 10 can then be returned to the seat manufacturer and reused to deliver additional seats.

A seat delivery pallet is described above. Various details of the invention may be changed without departing from its scope. Furthermore, the foregoing description of the preferred embodiments of the invention and best mode for practicing the invention are provided for the purpose of illustration only and not for the purpose of limitation.

I claim:

1. A seat delivery pallet, comprising:

(a) a platform having a top surface;

(b) spaced-apart first and second locking tracks positioned on the top surface of the platform substantially parallel to each other for securing a seat having a plurality of feet onto the platform, the first and second locking tracks being configured to receive the feet of the seat therein and to permit the seat to slide within the first and second locking tracks between a locking position and a release position;

(c) recesses on the top surface of the platform for receiving the feet of the seat therein and to allow the feet to be moved laterally and positioned in the first and second locking tracks; and (d) a lock positioned on the platform for cooperating with the seat to maintain the seat in the locking position and to release the seat from the locking position to allow removal of the seat from the platform.

2. The seat delivery pallet according to claim 1, wherein each of the first and second locking tracks includes:

(a) spaced-apart sidewalls extending along the length of the track; and (b) a slot between the spaced-apart sidewalls for receiving the feet therein.

3. The seat delivery pallet according to claim 2, wherein each of the spaced-apart sidewalls includes a horizontally oriented shoulder that extends inwardly from the respective sidewall to provide an undercut area beneath the shoulder.

4. The seat delivery pallet according to claim 1, wherein the recesses are integral with the first and second locking tracks.

5. The seat delivery pallet according to claim 1, wherein the lock is positioned adjacent to at least one of the first and second locking tracks to selectively block movement of the seat in the locking position.

6. The seat delivery pallet according to claim 1, and further including a plurality of castors attached to a bottom surface of the platform.

7. A seat delivery pallet, comprising:

(a) a platform having a top surface;

(b) spaced-apart first and second locking tracks positioned on the top surface of the platform for securing a seat having a plurality of feet onto the platform, the first and second locking tracks being configured to receive the feet of the seat therein and to permit the seat to slide within the first and second locking tracks between a locking position and a release position; and (c) a lock positioned on the platform for cooperating with the seat to maintain the seat in the locking position and to release the seat from the locking position to allow removal of the seat from the platform;

wherein each of the first and second locking tracks includes recesses adjacent to and cooperating with a gap in the locking track to allow the feet to be installed or removed from the first and second tracks in the release position.

8. A seat delivery pallet, comprising:

(a) a platform having a top surface;

(b) spaced-apart first and second locking tracks positioned on the top surface of the platform for securing a seat having a plurality of feet onto the platform, the first and second locking tracks being configured to receive the feet of the seat therein and to permit the seat to slide within the first and second locking tracks between a locking position and a release position; and (c) a lock positioned on the platform for cooperating with the seat to maintain the seat in the locking position and to release the seat from the locking position to allow removal of the seat from the platform;

wherein the lock is positioned in a recess on the platform adjacent to one of the first and second locking tracks to allow the lock to extend through a sidewall and block movement of the seat in the locking position.

9. The seat delivery pallet according to claim 8, wherein the lock includes a pin and an actuating device operable to force the pin through the sidewall to a position where the pin interferes with the seat to prevent movement of the seat in the locking position.

10. A seat delivery pallet adapted to secure a seat having feet with enlarged locking stud&, comprising:

(a) a platform;

(b) spaced-apart, generally parallel first and second locking tracks adapted to receive the feet therein such that the feet can slide between a locking position and a release position while preventing the feet from moving vertically out of the first and second locking tracks, each of the first and second locking tracks including:

(i) spaced-apart horizontally positioned shoulders adapted to prevent the feet from moving vertically;

(ii) recesses adjacent to each of the first and second locking tracks to allow the feet to be moved laterally into the first and second locking tracks; and (iii) a lock moveable between a lock position and a release position to selectively prevent the seat from sliding within the first and second locking tracks in the lock position.

11. A method of delivering a seat having feet with enlarged locking studs, comprising the steps of:

(a) providing a seat delivery pallet, comprising:

(i) a platform;

(ii) spaced-apart first and second locking tracks positioned on a top surface of the platform; and (iii) a lock positioned within a recess on the platform adjacent at least one of the first and second locking tracks;

(b) positioning the seat in the first and second locking tracks; and (c) moving the lock from a release position to a lock position to prevent removal of the seat from the platform.

12. The method according to claim 11, and further including the step of positioning the feet of the seat into respective recesses adjacent the first and second locking tracks to permit the feet to be moved laterally into the first and second locking tracks.

13. The method according to claim 12, wherein the step of moving the lock includes the prior step of sliding the seat within the first and second locking tracks with the lock in the release position where the seat can be removed from the platform to a locking position where the seat is secured to the platform with the lock in the lock position.

* * * * *